US006341880B1

(12) United States Patent
Hsu

(10) Patent No.: US 6,341,880 B1
(45) Date of Patent: Jan. 29, 2002

(54) SHADE ON A LAMP

(76) Inventor: Angela Hsu, 8F-4, No. 4, Lane 226, Jen-Ai Road, Lin Kou Hsiang, Taipei Hsien (TW)

( * ) Notice: Subject to any disclaimer, the term of this patent is extended or adjusted under 35 U.S.C. 154(b) by 0 days.

(21) Appl. No.: 09/576,236

(22) Filed: May 24, 2000

(51) Int. Cl.[7] ..... F21V 11/00
(52) U.S. Cl. ..... 362/352; 362/353; 362/356
(58) Field of Search ..... 362/352, 356, 362/357, 353

(56) References Cited

U.S. PATENT DOCUMENTS 5,571,280 A * 11/1996 Lehrer ..... 362/352
6,206,551 B1 * 3/2001 Stubblefield, Jr. ..... 362/352 X

* cited by examiner

*Primary Examiner*—Stephen Husar
(74) *Attorney, Agent, or Firm*—Troxell Law Office PLLC

(57) ABSTRACT

A shade for a lamp consists of a shade part and a frame. The shade part has radial flips with a central hole. Each flip comprises an arc folding lines and two radial partition folding lines around the central hole, two face folding lines at two lateral edges thereof, and an end folding lines at the outer end thereof. The outer end is provided with an engaging hole. The frame comprises an outer skeleton with skeleton sections, a central ring and radial liking ribs. Each of the skeleton sections at the middle portion thereof has an inward engaging tab with a through hole to engage with the engaging hole on the flip. A shade is formed by way of all the folding lines on the shade part being folded and the folded shade part being fitted with the frame.

4 Claims, 2 Drawing Sheets

SHADE ON A LAMP

BACKGROUND OF THE INVENTION

1. Field of The Invention

The present invention relates to a shade on a lamp and particularly to an improvement of a shade attached on a lamp.

2. Description of Related Art

It is known that an illuminating device is provided wherever we are and it is possible to supply light source all the time such that our activities can be prolonged from day to night as desired without any difficulty to enrich our life style.

In fact, a broad definition of the illuminating device is an emitter including a shade in addition to a bare light bulb and it is essential for an illuminating device especially such as a suspending lamp or a table lamp attaching a shade. The shade for a lamp not only provides an effect of cutting off light emission but also offer a function of visional enhancement. When a consumer selects a table lamp during shopping, a favorite shade is a determinate factor for him/her to buy the lamp and this is an experience we have met before frequently.

However, the shade may cause a substantial increase of transportation cost while a lamp is delivered. Especially, the shade is fixedly attached on a lamp and a larger package is required such that a gross volume increases naturally for shipment to result in a higher delivery expense. Accordingly, it is conceivable that the shade having large size causes much inconvenience and extra cost from the manufacture to the consumer.

SUMMARY OF THE INVENTION

An object of the present invention is to provide a shade on a lamp, which is easier to fit with a light bulb.

Another object of the present invention is to provide a shade on a lamp, which is light in weight for delivery.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
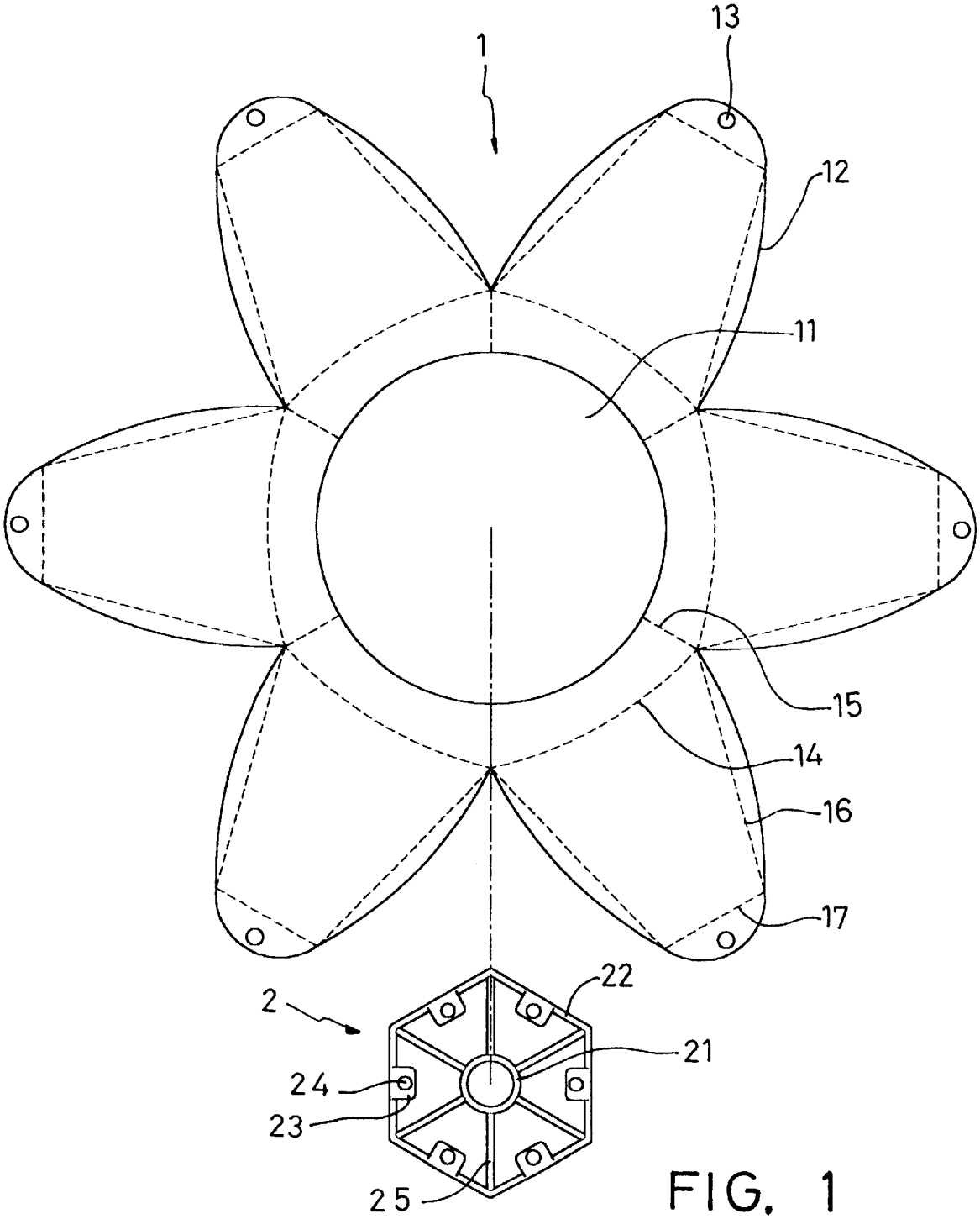
FIG. 1 is a disassembled extended view of a shade on a lamp in accordance with the present invention.

Referring to FIG. 1, basically, a shade on a lamp of the present invention comprises a shade part 1, a frame part 2.

The shade part 1 is made of a sheet material and a shade hole 11 is provided at the central location thereof to be passed through by the light. A plurality of radial flips 12 extends outward surrounding the shade hole 11 such that an equal angular distance between any two adjacent flips 12 is constituted. It is noted that the total number of the flips 12 is a variable depending on the actual need but a minimum number of three flips is a least requirement. The embodiment illustrated in FIG. 1 has six flips and it is an example only. The outer end of each flip 12 is provided with an engaging hole 13 for engaging with the frame 2.

In order to form a shade, each flip 12 at the inner end thereof near the shade hole 11 has an arc foldable line 14. The folding line 14 intersects the inner part at both corner ends thereof and a radial partition folding line 15 is formed between each corner end and the hole 11. Each flip 12 at both lateral edge thereof has a straight face folding line 16 respectively and a straight end folding line 17 is located at the outer end of each flip 12 and disposed between both face folding lines 16 for angle adjustment.

The frame 2 has a size corresponding to a size enclosed by all the end folding lines 17 so that the frame 2 has the same shape of the shade part 1. As illustrated in FIG. 1, the frame 2 is hexagon shape. The frame 2 has a central ring 21 to engage with the bulb head of a light bulb and has an outer skeleton with skeleton sections 22. Each skeleton section 22 at the middle portion thereof has an inward engaging tab 23 and a fitting hole 24 passes through the tab 23 respectively. T he central ring 21 can be arranged at the same height with the skeleton sections 22 or a different height from the skeleton sections 22. The outer skeleton connects with the central ring 21 by way of radial ribs.

Figure 2:
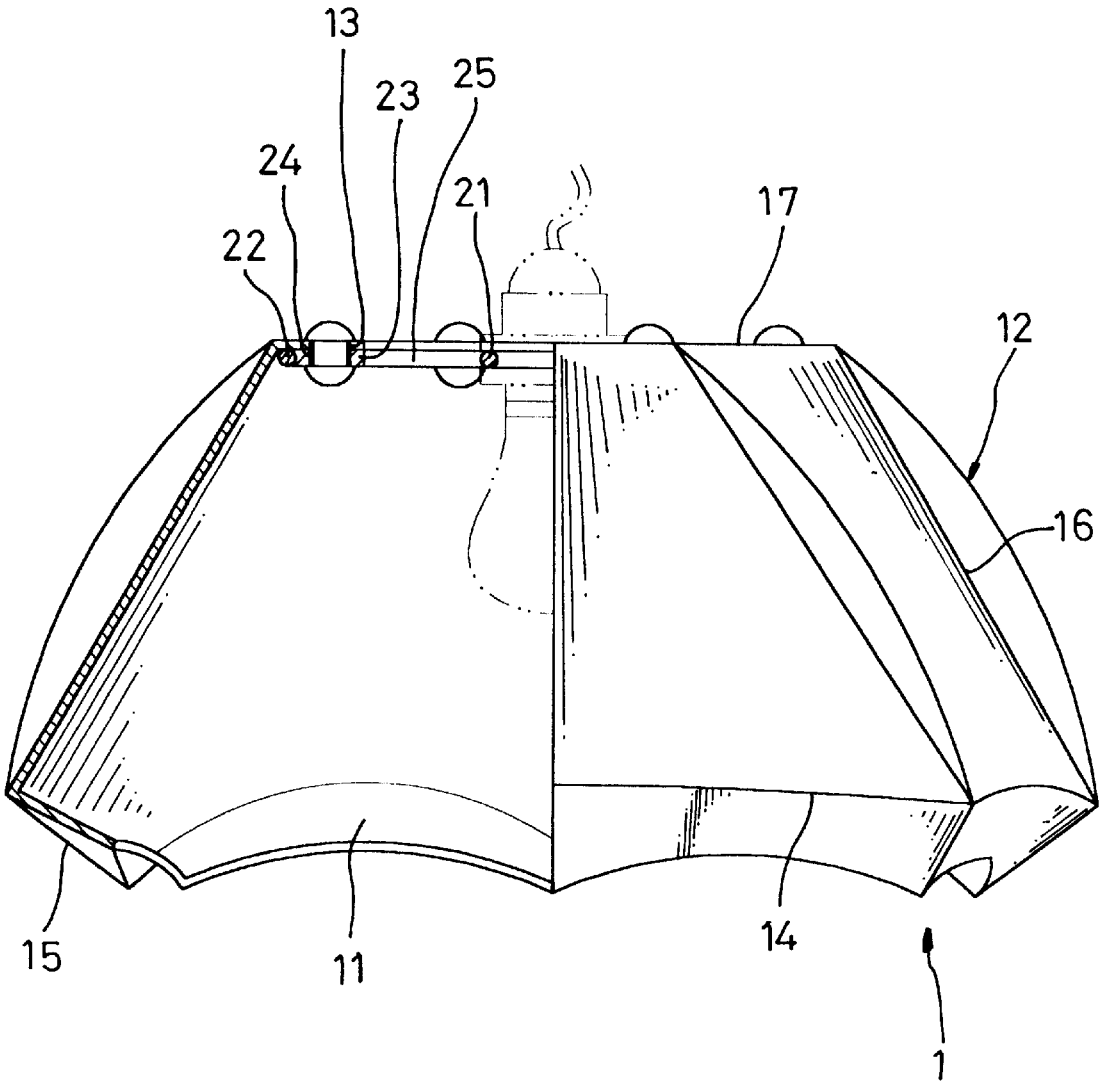
FIG. 2 is a semi-sectional view of the shade for lamp shown in FIG. 1 after assembly.

Referring to FIG. 2, the shade part 1 is folded along the folding lines to form a hexagon shade such that the top thereof is smaller than the bottom thereof. The bottom of the shade further has an inward extending lower edge. Meanwhile, the shade part 1 and the frame 2 are fitted with each other and then the fitting holes 24 and the engaging holes 13 are aligned with each other respectively and passed through and fixed by conventional fasteners. Once each flip is distorted and unable to engage tightly, the area between the face folding line 16 and the respective lateral edge is coated with glue respectively to adhere adjacent flips. Thus, the central ring 21 can fit with the light head accordingly.

The shade part 1 can be made of plastics, paper or other sheet material and the frame can be made of metal or plastics. In practice, the shade of the present invention can be done by the existing technique absolutely.

It is appreciated that the shade on a lamp in accordance with the present invention is easily self-assembled and the shade part and the frame have a little thickness respectively. The delivery cost of the shade is much lower than that of the prior art shade. Therefore, it is obvious that the advantages of the present invention are not possible to be reached by the prior art.

While the invention has been described with reference to a preferred embodiment thereof, it is to be understood that modifications or variations may be easily made without departing from the spirit of this invention, which is defined by the appended claims.

What is claimed is:

1. A shade on a lamp, comprising a shade part, being made of sheet material, having a plurality of radial flips with equally angular distance extending outward surrounding a central hole, each of the flips having an inner part with two corner ends near the central hole, two opposite lateral edges, and an outer end with an engaging hole; and a frame, having a central ring, an outer skeleton with skeleton sections, and a plurality of radial ribs linking the outer skeleton and the central ring, and each of the skeleton section at the middle portion thereof having an inward engaging tab with a through fitting hole to be aligned with the engaging hole and passed through by fasteners for engagement;

wherein, the flip further comprises an arc folding line intersecting the corner ends, a radial partition folding line being extending inward from each corner end to the central hole, a straight face folding line being formed near each of the lateral edges, a straight end folding line being located at the outer end and between the face folding line; and the frame has a size corresponding to a size of the shade part after the end folding lines being enclosed;

whereby, the shade is formed in a shape of a top thereof being smaller than a bottom thereof after each of the folding lines having been folded.

2. The shade on a lamp as defined in claim 1, wherein the shade part has six flips and the frame is hexagon shape.

3. The shade on a lamp as defined in claim 1, wherein any two adjacent flips can be glued together at respective border area folded out along the respective face folding line.

4. The shade on a lamp as defined in claim 1, wherein a difference in height may be provided between the central ring and the outer skeleton.

* * * * *